US010058486B2

(12) United States Patent
Steward

(10) Patent No.: US 10,058,486 B2
(45) Date of Patent: Aug. 28, 2018

(54) TWO-STAGE TEETHING MITTEN

(71) Applicant: Julie K. Steward, Nanaimo (CA)

(72) Inventor: Julie K. Steward, Nanaimo (CA)

( * ) Notice: Subject to any disclaimer, the term of this patent is extended or adjusted under 35 U.S.C. 154(b) by 243 days.

(21) Appl. No.: 14/609,330

(22) Filed: Jan. 29, 2015

(65) Prior Publication Data

US 2015/0209240 A1 Jul. 30, 2015

Related U.S. Application Data

(60) Provisional application No. 61/933,245, filed on Jan. 29, 2014.

(51) Int. Cl.
*A61J 17/00* (2006.01)
*A61J 17/02* (2006.01)

(52) U.S. Cl.
CPC ..... *A61J 17/02* (2013.01); *A61J 17/007* (2015.05)

(58) Field of Classification Search
CPC ..... A61J 17/00; A61J 17/001; A61J 17/007; A61J 17/008; A61J 17/02; A61J 17/002; A61J 17/003; A61J 17/005; A63H 3/003; A63H 3/02; A63H 3/14; A61F 5/50; A61H 13/00; A61H 13/005; A41D 19/01; A41D 19/0024; A41D 19/0027; A41D 19/0031; A41D 19/0044; A41D 19/0048; A41D 13/087; A41D 13/088; A45F 5/02; A45F 2005/023; A45F 2005/025; A45F 2005/026; A45F 2005/027; A45F 2005/028
USPC ..... 606/234–236
See application file for complete search history.

(56) References Cited

U.S. PATENT DOCUMENTS

| | | | | |
|---|---|---|---|---|
| 2,586,608 | A | 2/1952 | Bryson | |
| 4,972,980 | A * | 11/1990 | Parsons | A61J 17/00 224/194 |
| 4,985,968 | A * | 1/1991 | Hooper | A44C 3/001 24/3.13 |
| 5,385,573 | A | 1/1995 | Wright | |
| 5,993,285 | A | 11/1999 | Sofia et al. | |
| 6,461,214 | B1 * | 10/2002 | Lynch | A61J 17/001 446/227 |
| 6,905,507 | B2 * | 6/2005 | Hinshaw | A61J 17/02 606/235 |
| D509,628 | S | 9/2005 | Gilbert, Jr. | |
| 8,062,087 | B1 * | 11/2011 | Davis | A63H 3/003 446/26 |
| D697,274 | S | 1/2014 | Thorne | |
| 2005/0222621 | A1 | 10/2005 | Duwelius et al. | |
| 2006/0004412 | A1 | 1/2006 | Gilbert, Jr. | |
| 2006/0041275 | A1 * | 2/2006 | Powers | A41B 13/00 606/215 |

(Continued)

*Primary Examiner* — Darwin Erezo
*Assistant Examiner* — Katherine Schwiker
(74) *Attorney, Agent, or Firm* — Oyen Wiggs Green & Mutala

(57) ABSTRACT

A two-stage teething mitten is provided that includes a fabric pocket defining an interior cavity adapted to enclose an infant hand. An opening is provided in the pocket to accommodate the insertion of an infant hand into the interior cavity. An elongate strap is positioned on the pocket adjacent the opening for detachably securing about the circumference of a wrist of the infant hand. A detachable teething member, which may take the form of a sleeve dimensioned to partially enclose the pocket, a teething ruff that may be attached to the elongate strap, or a second replacement fabric pocket, is provided.

11 Claims, 13 Drawing Sheets

(56) References Cited

U.S. PATENT DOCUMENTS

| | | | | |
|---|---|---|---|---|
| 2006/0168765 | A1* | 8/2006 | Beatty | A45F 5/02 24/3.13 |
| 2007/0288056 | A1* | 12/2007 | Goldwire | A41D 19/0024 606/235 |
| 2009/0013449 | A1* | 1/2009 | Kahn | A42B 1/24 2/209.13 |
| 2009/0163952 | A1* | 6/2009 | Kash | A61J 17/001 606/236 |
| 2010/0304636 | A1* | 12/2010 | Seiz | A63H 3/003 446/72 |
| 2012/0259362 | A1* | 10/2012 | Weinland | A61J 17/02 606/235 |
| 2013/0085530 | A1 | 4/2013 | Caputo | |
| 2013/0089276 | A1* | 4/2013 | Noble | B65D 85/00 383/42 |
| 2013/0245687 | A1 | 9/2013 | Bachmann | |
| 2013/0304121 | A1 | 11/2013 | Hakim | |
| 2014/0207187 | A1* | 7/2014 | Kiraly | A41D 19/0037 606/223 |
| 2015/0004872 | A1* | 1/2015 | Taylor | A63H 3/02 446/227 |

* cited by examiner

TWO-STAGE TEETHING MITTEN

FIELD OF THE INVENTION

The present invention relates to a two-stage teething mitten for infants.

BACKGROUND OF THE INVENTION

Teething is the process by which an infant's first teeth emerge through the gums. The first teeth typically appear between six and nine months, however teething may start as early as three months or as late as twelve months. When an infant begins teething, there is no set pattern as to when it will begin, how long it will take or how painful it will be. For some infants, the process is relatively quick and without pain, while others go through a long, drawn out and painful teething experience.

Common symptoms include drooling or dribbling, mood changes, irritability or crankiness, and swollen gums. Babies who are experiencing some pain and swelling may begin chewing on their fingers or toys to help relieve pressure on their gums. Babies who are experiencing severe discomfort may chew or bite on their fingers, thumbs or hands hard enough to cause redness, swelling, and even bleeding, which may add to the discomfort.

A common solution is to offer the baby a teething ring or toy which is typically a soft plastic device that can be chewed on and allows the baby to break down some of the gum tissue and to promote the growth of the teeth out of the gum. It also allows some relief from the pressure and pain that some babies experience. Some examples of teething devices are U.S. Design Pat. No. D697274; Canadian Patent App. Nos. 2719930 and 2508210; and U.S. Pub. Nos. 2013304121 and 20130085530. Some teething rings however, can easily become broken or damaged while other poorly-designed toys may be small enough for a child to swallow or choke on. Others are difficult for a baby to hold or pick up when they want to begin chewing, necessitating an adult to repeatedly pass the toy to the baby after it slips away from the baby, or for a new toy if the first one drops on the floor and is dirtied or lost. Others teething aids, such as U.S. Pub. No. 2013245687, involve a cover placed over an adult finger or on an adult hand, which again requires an adult to assist the baby.

Teething mittens, such as those shown in U.S. Design Pat. No. D509628, U.S. Pat. Nos. 5,993,285, 5,385,573, and 2,586,608; U.S. Pub. Nos. 20060004412 and 20050222621; GB Pub. No. 2417426; and Japanese Pub. No. 2006291433, have also been used. These of course provide autonomy to the infant because they are secured directly to the infant's body; however during the course of chewing some babies exert painful sharp or biting pressure on the hand, causing further discomfort to the baby. Further, some of the designs are relatively uninteresting to the baby. In addition, the teething portions of the mittens are an integral part of the mitten. The teething portions would tend to interfere with simple protection of the infant's hands, in order, for example, to protect the baby from scratching its face; to prevent the baby from germs when crawling or travelling; or simply to keep the baby's hands warm in winter, without falling off. Accordingly it may not be desirable to use such teething mittens until the baby is actually teething and begins chewing things to relieve the discomfort.

It is therefore an object of the invention to provide a teething mitten that overcomes the foregoing disadvantages.

It is a further object of the invention to provide a teething mitten that includes the ability to allow a baby to chew the mitten comfortably, to relieve the pain and stress of teething without causing further pain or discomfort to the baby's fingers, thumb and hand.

It is a further object of the invention to provide a teething mitten that may be used both before and during the teething phases of a baby's development, providing aspects that are interesting to the baby as well as useful and protective before and during teething.

These and other objects of the invention will be better understood by reference to the detailed description of the preferred embodiment which follows. Note that the objects referred to above are statements of what motivated the invention rather than promises. Not all of the objects are necessarily met by all embodiments of the invention described below or by the invention defined by each of the claims.

SUMMARY OF THE INVENTION

In one aspect, the invention comprises a teething mitten, comprising a first fabric pocket defining an interior cavity adapted to enclose an infant hand; an opening in the first fabric pocket to accommodate the insertion of the infant hand into the interior cavity; an elongate strap adjacent the opening for detachably securing the teething mitten about the circumference of a wrist of the infant hand; and a teething member removably attachable to the teething mitten, the teething member having an exterior surface that is at least partially texturized.

In a further aspect, the teething member may be a detachable sleeve dimensioned to partially enclose the first fabric pocket, the detachable sleeve being closed at one end, and having an opening at the other end through in which the first fabric pocket is inserted. At least one fastener may be provided for maintaining the detachable sleeve in a position overlying a portion of the first fabric pocket. The detachable sleeve may be fabricated from silicon. The texturized exterior surface of the detachable sleeve may be a plurality of raised projections.

In yet a further aspect, the elongate strap may be provided with opposed ends removably connectable to each other. The opposed ends may be removably connectable to each other through a connector selected from the group consisting of mating tape, hook and loop fasteners, snap closures, ties, elastic, and buttons. The elongate strap may be detachably secured to the first fabric pocket.

In a further aspect, the teething mitten may comprise a thumb pocket or an aperture in the first fabric pocket to accommodate a thumb of the infant hand.

In a further aspect, the teething member may be a teether removably secured to the elongate strap. The teether may be fabricated from silicon. The texturized exterior surface of the teether may be a plurality of raised projections.

In yet a further aspect, the teething mitten may also comprise a toy. The toy may be permanently attached or removably attached to the elongate strap, and/or to the teether. Attaching the toy to the elongate strap may also hold the teether on to the elongate strap.

In a further aspect, the teething member may comprise a second fabric pocket defining an interior cavity adapted to enclose the infant hand, having an opening in the fabric pocket to accommodate the insertion of the infant hand into the interior cavity, and having one or more textured portions permanently affixed to the second fabric pocket; the second fabric pocket may replace the first fabric pocket on the elongate strap.

The foregoing was intended as a summary only and of only some of the aspects of the invention. It was not intended to define the limits or requirements of the invention. Other aspects of the invention will be appreciated by reference to the detailed description of the preferred embodiments. Moreover, this summary should be read as though the claims were incorporated herein for completeness.

BRIEF DESCRIPTION OF THE DRAWINGS

These and other features will become more apparent from the following description in which reference is made to the appended drawings, the drawings being for the purpose of illustration only and not being intended to be in any way limiting, wherein.

DETAILED DESCRIPTION

Figure 2:
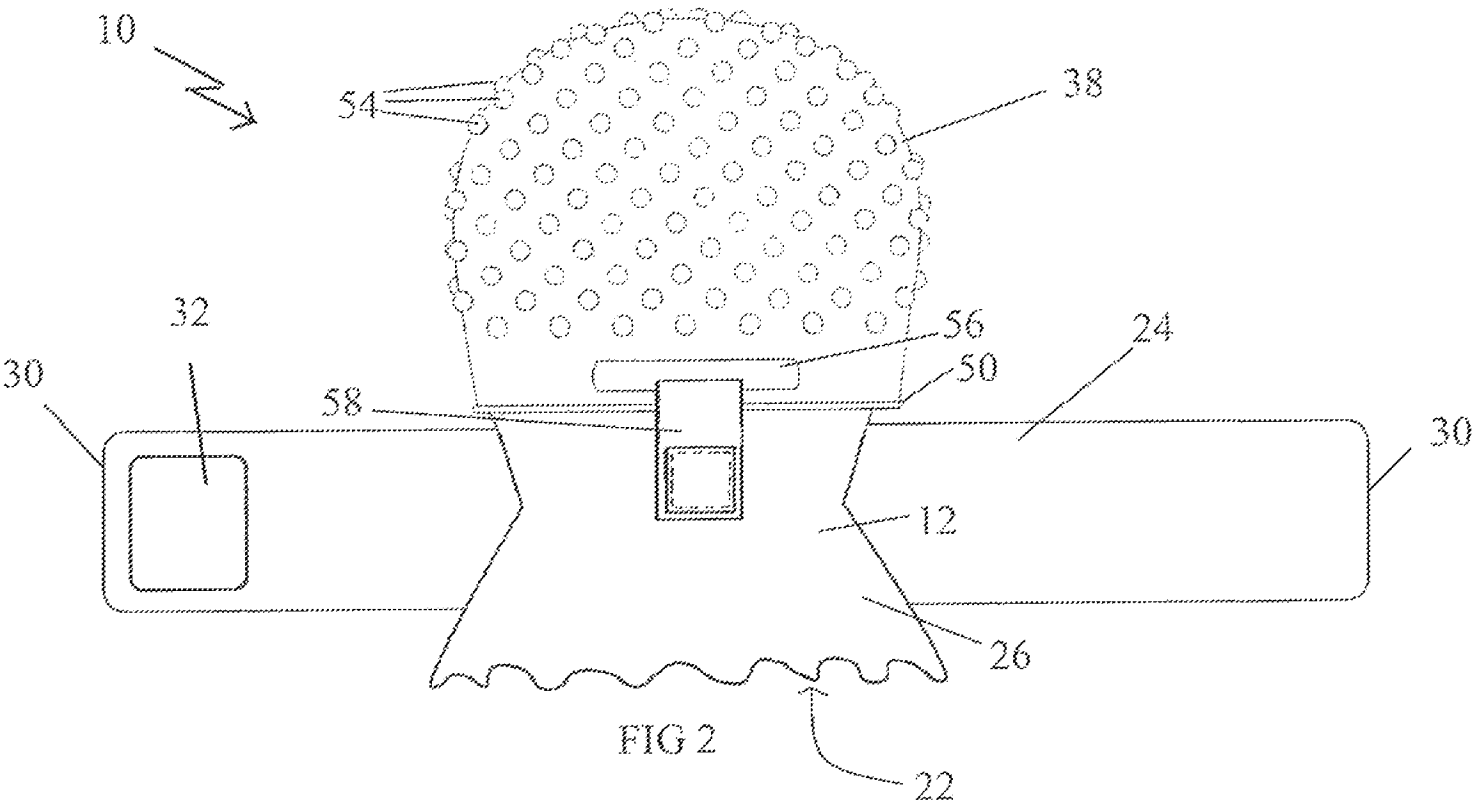
FIG. 2 is a back view of the teething mitten of FIG. 1.
Figure 3:
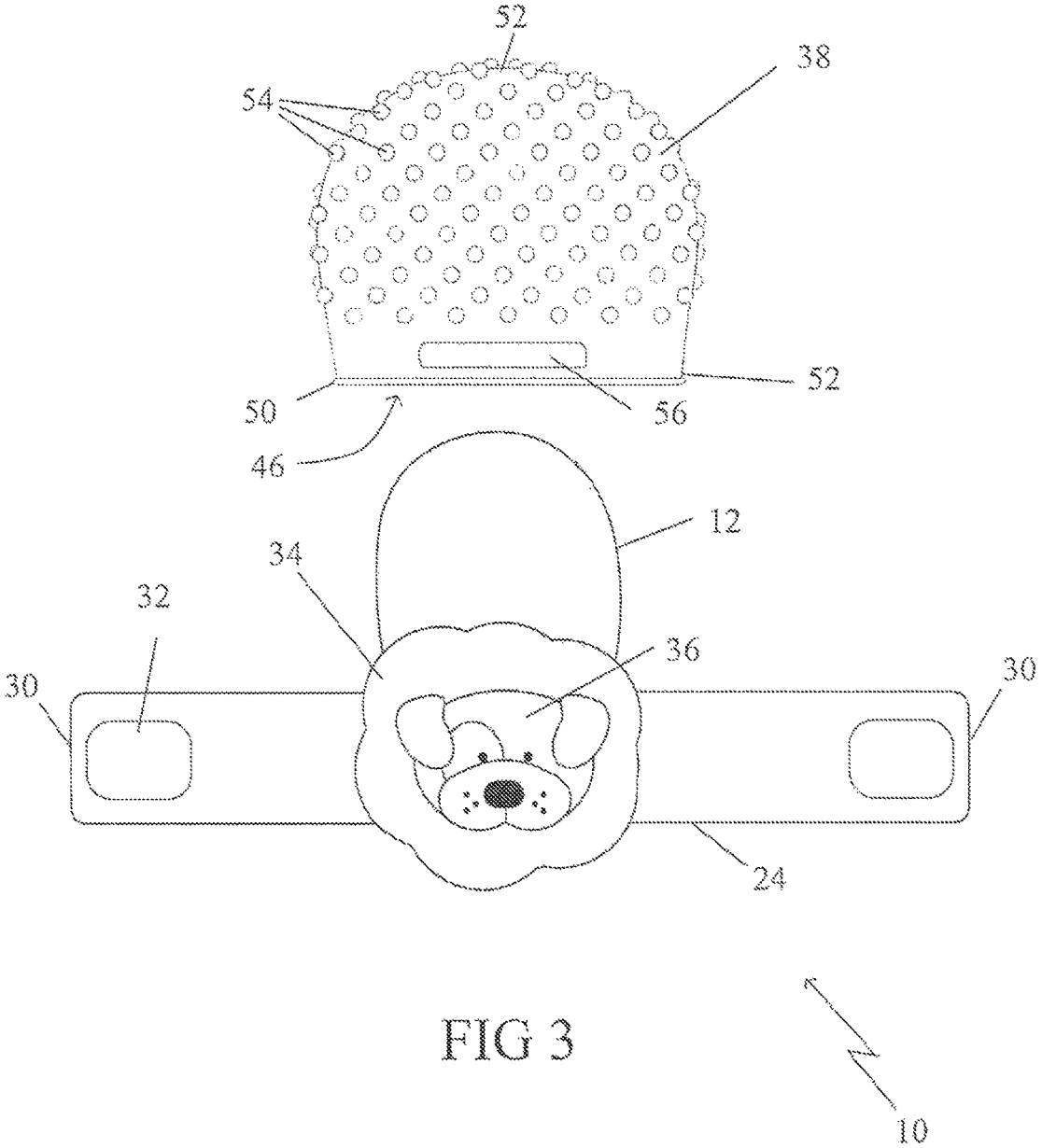
FIG. 3 is an exploded view of the teething mitten of FIG. 1.
Figure 4:
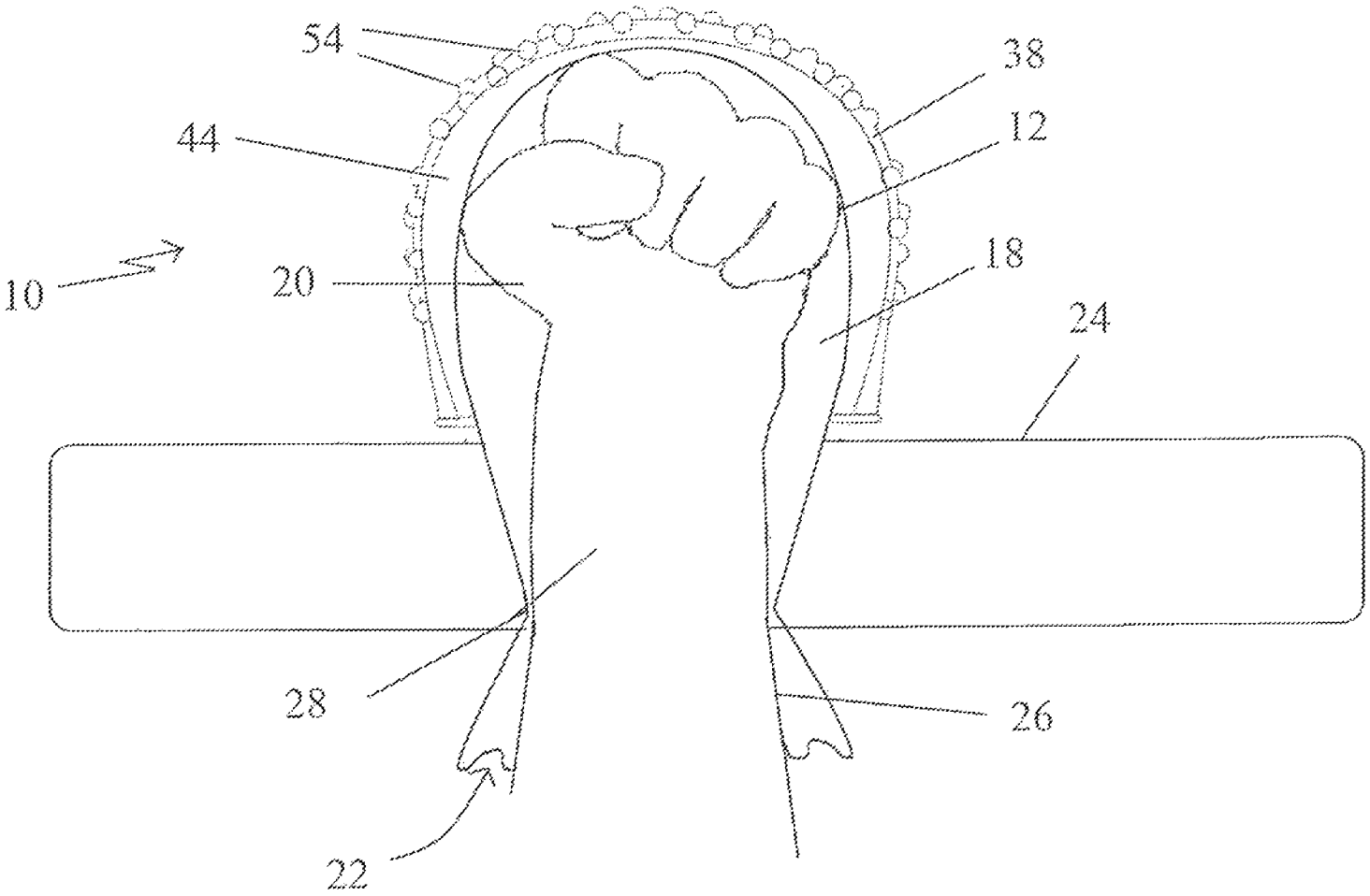
FIG. 4 is a sectional view of the teething mitten of FIG. 1, fitted over the hand of an infant.

Referring to FIGS. 1-11, an embodiment of a teething mitten, generally identified by reference numeral 10, comprises a fabric pocket 12. The fabric pocket 12 has a first exterior side 14 (best shown in FIG. 5) and a second exterior side 16 (best shown in FIG. 6). Referring to FIG. 4, the pocket 12 is shaped to define an interior cavity 18 adapted to enclose an infant's hand 20. An opening 22 is provided in the pocket 12 to facilitate the insertion of the infant's hand 20 into the interior cavity 18. An elongate strap 24 is attached to the pocket 12 adjacent the opening 22 for detachably securing a lower end 26 of the pocket 12 of the teething mitten 10 about the circumference of a wrist 28 of an infant's hand 20 as best illustrated in FIG. 4. In this embodiment, elongate strap 24 may be permanently attached to the pocket, such as by sewing, gluing, or other suitable method, or it may be detachably attached to the packet 12 such as with Velcro®, snaps or other suitable fastening means. The pocket 12 may be fabricated from patterned or solid fabrics, in one or more pieces, as desired.

Figure 1:
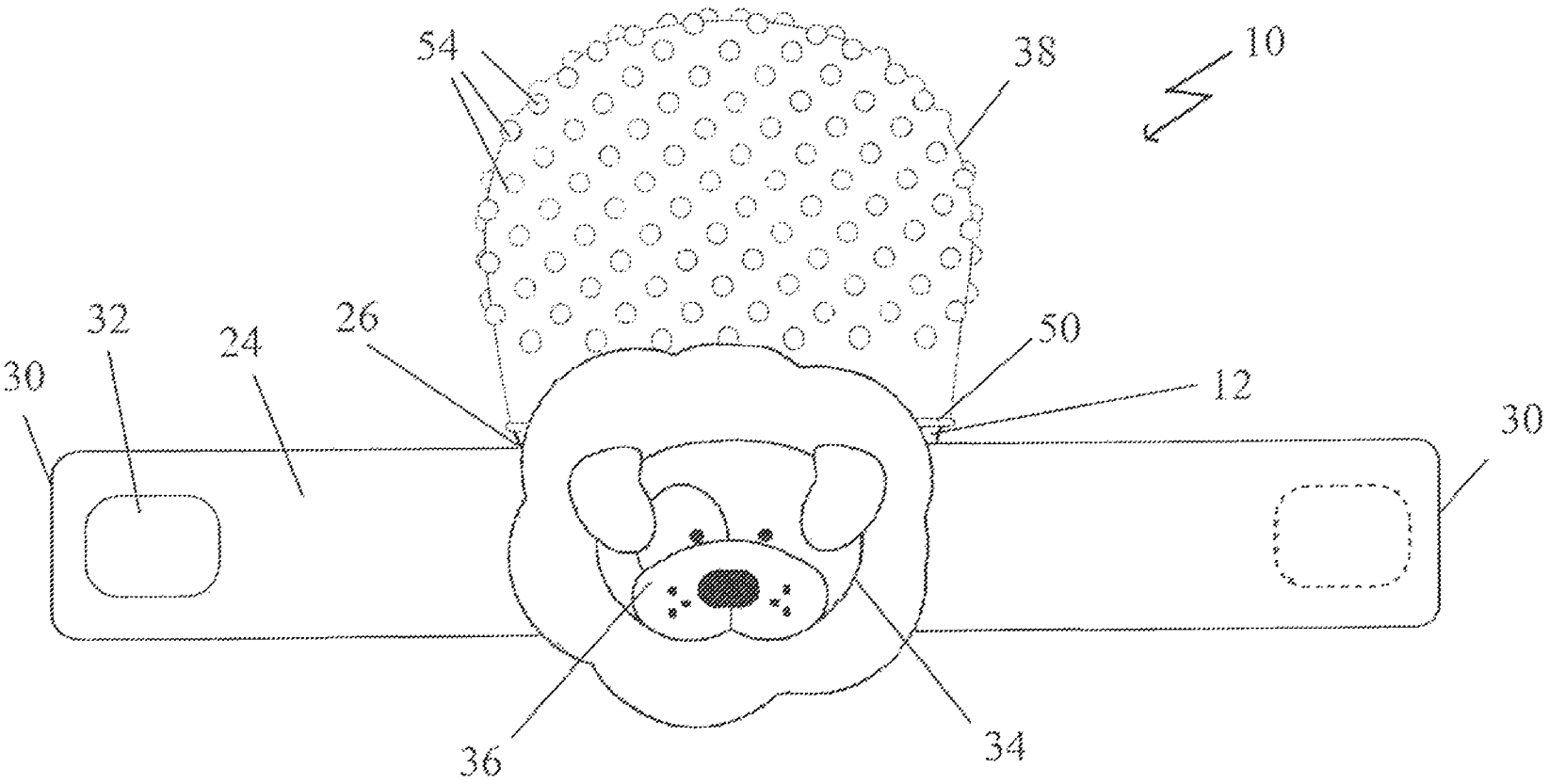
FIG. 1 is a front view of a first embodiment of the teething mitten.

Referring to FIG. 1, the elongate strap 24 has opposed ends 30. A connector such as mating tape 32 is provided at the opposed ends 30 such that the opposed ends 30 of the strap 24 will mate when overlapped with each other to secure the teething mitten 10 about the infant's wrist 28 (not shown). While mating tape 32 is illustrated as a means of securing the opposed ends 30, it will be appreciated that there are other manners of securing the teething mitten 10 about the infant's wrist including elastics, buttons, snap closures, ties, hook and loop fasteners such as Velcro®, and elasticized fabric.

The elongate strap 24 may be bare or a toy 34 may be provided on the elongate strap 24 intermediate the opposed ends 30. The toy 34 is visible to the infant when worn and serves to attract and hold the infant's attention. The toy 34 is preferably three dimensional and is preferably constructed from soft stuffed fabric so that it will not injure the infant during use. If a toy 34 is provided, it may be permanently attached to the elongate strap 24, such as by sewing, gluing, or other suitable method, or it may be detachably attached to the elongate strap 24 such as with Velcro®, snaps or other suitable fastening means. In the illustrated embodiment, the toy 34 is an animal character 36, but it will be appreciated that it could be any other type of character or representation. It will also be appreciated that the toy 34 could include a rattle, a bell, crinkly material and/or other features that infants find attractive. Other toys that are stimulating or have developmental attributes can also be used.

A detachable teething member, such as detachable sleeve 38, the details of which are best shown in FIGS. 7-10, is provided. Detachable sleeve 38 is dimensioned to overlie a portion of the pocket 12. The detachable sleeve 38 has a first side 40, a second side 42, and an interior cavity 44. Interior cavity 44 is slightly larger than the outer dimensions of the pocket 12 such that pocket 12 can fit comfortably inside without substantial creasing or folding. It has an opening 46 at a first end 52 through which the pocket 12 can be inserted. A rounded lip 50 preferably surrounds the opening 46. It is closed at a second end 48.

One or both sides of the sleeve 38 is preferably texturized, such as with raised teething bumps 54. Although illustrated with teething bumps 54, it will be appreciated that other textures and patterns of raised protrusions could also be used to facilitate teething. It will also be appreciated that a combination of different textures and patterns of raised protrusions of varying sizes and shapes could also be used. The sleeve 38 could be substantially or partially covered in textures. When the pocket 12 is inserted into the interior cavity 44 of the sleeve 38, the sleeve 38 will overlie a portion of the pocket 12 as shown in FIG. 1.

Sleeve 38 is preferably fabricated from food or medical grade silicon or a similar material that is safe, hygienic and sufficiently flexible to be comfortable for the infant wearing the teething mitten 10 but also be sufficiently resilient that it will not break down under repeated chewing and teething efforts, while preventing the infant from applying excess pressure on the infant's hand while biting or gnawing on the sleeve 38 to relieve pressure on their gums. The sleeve 38 can be transparent, translucent, coloured or opaque as desired. In the illustrated embodiment, the sleeve 38 is shown as covering the majority of pocket 12 above elongate strap 24, however it is conceivable that the sleeve 38 could cover less of the pocket 12 and still function as intended.

Figure 6:
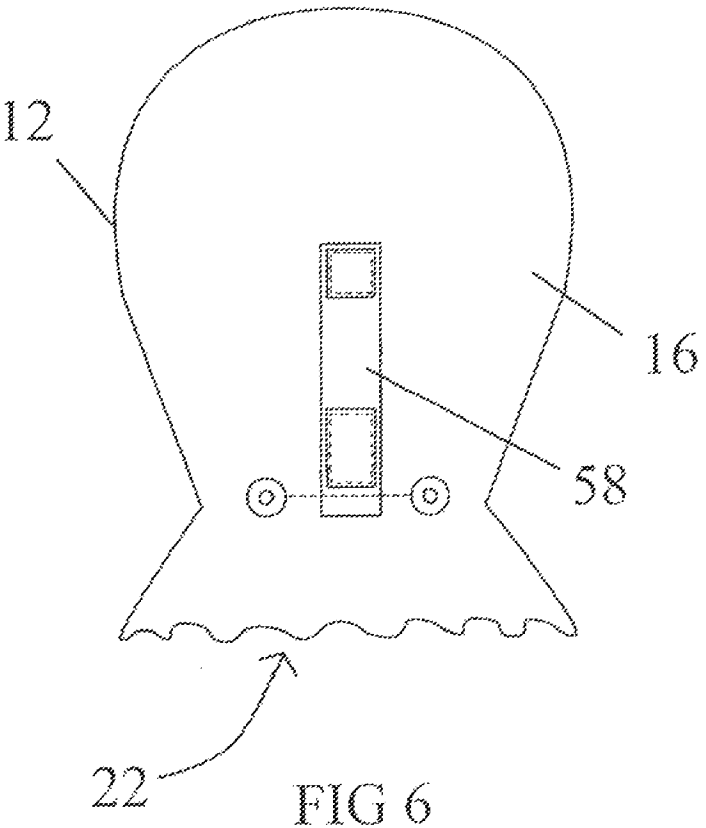
FIG. 6 is a back view of the fabric pocket of the teething mitten of FIG. 1.
Figure 5:
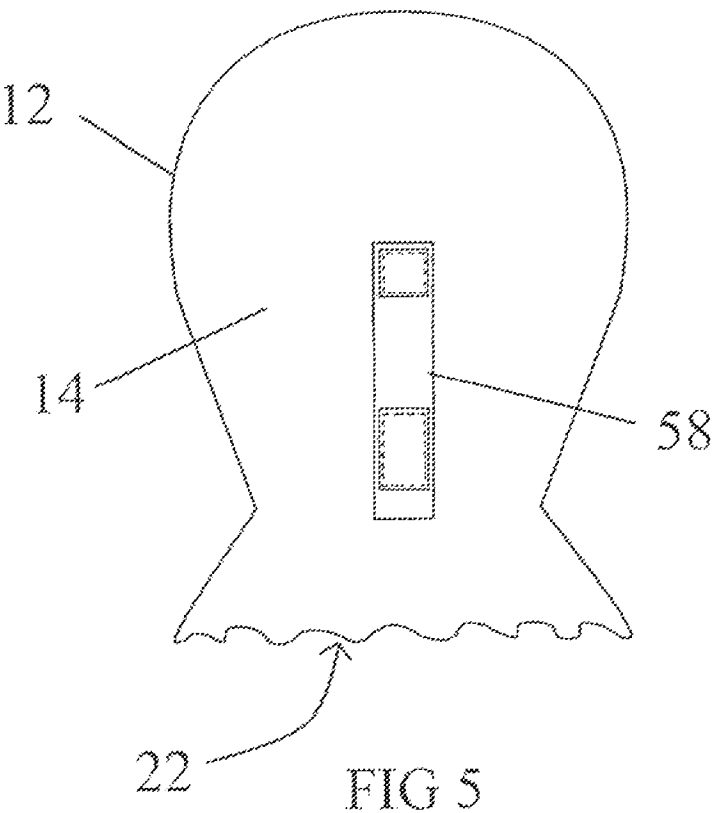
FIG. 5 is a front view of the fabric pocket of the teething mitten of FIG. 1.
Figure 7:
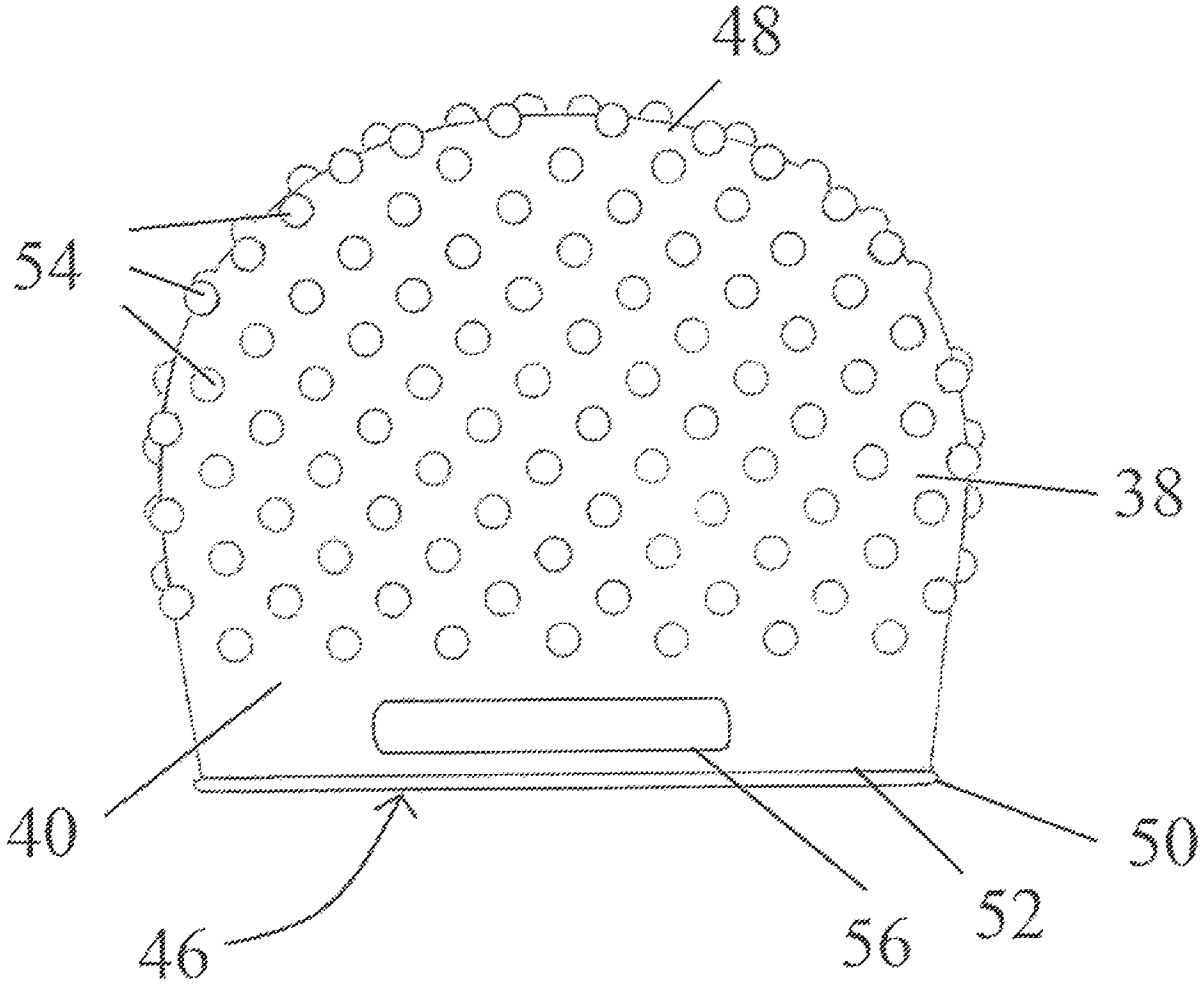
FIG. 7 is a view of a first side of a detachable sleeve for the teething mitten of FIG. 1.
Figure 8:
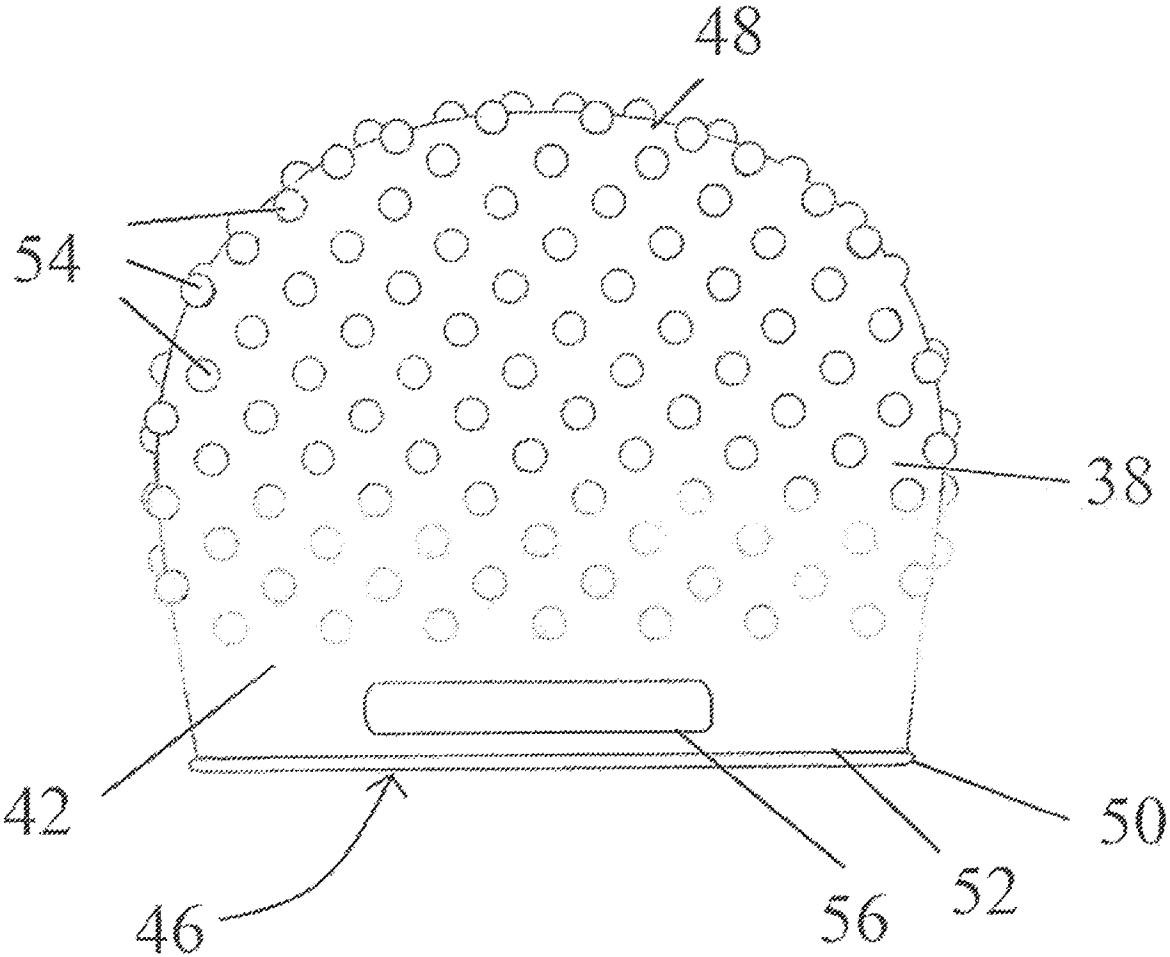
FIG. 8 is a view of a second side of the detachable sleeve for the teething mitten of FIG. 1.
Figure 9:
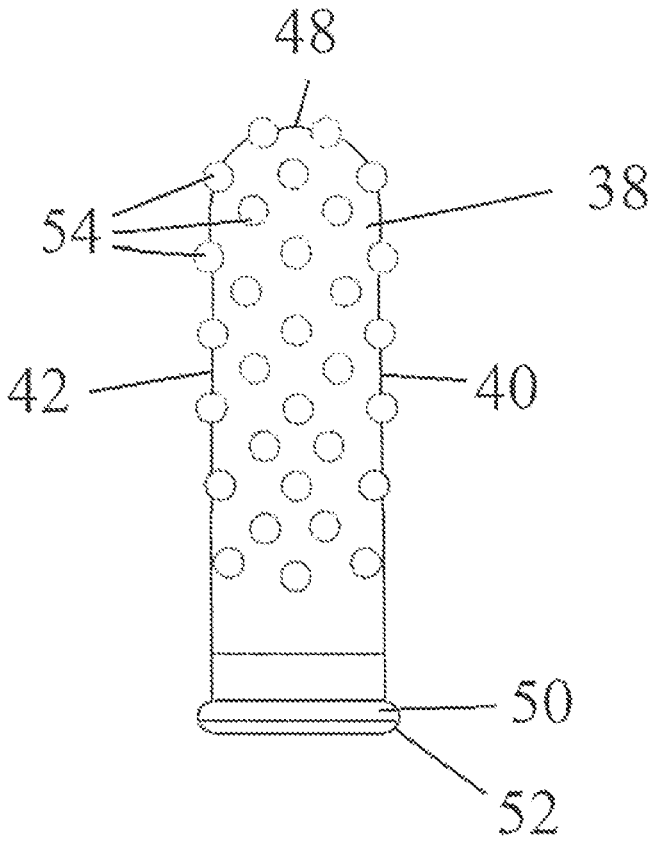
FIG. 9 is a side view of the detachable sleeve for the teething mitten of FIG. 1.
Figure 10:
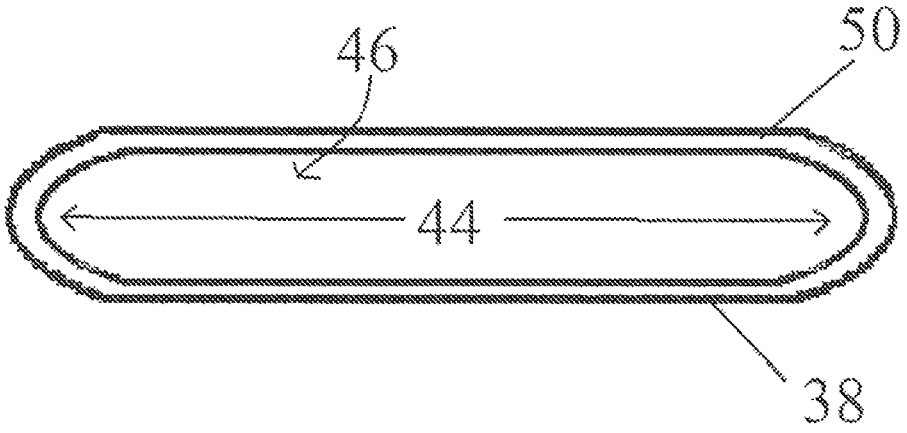
FIG. 10 is a bottom view of the detachable sleeve for the teething mitten of FIG. 1.
Figure 11:
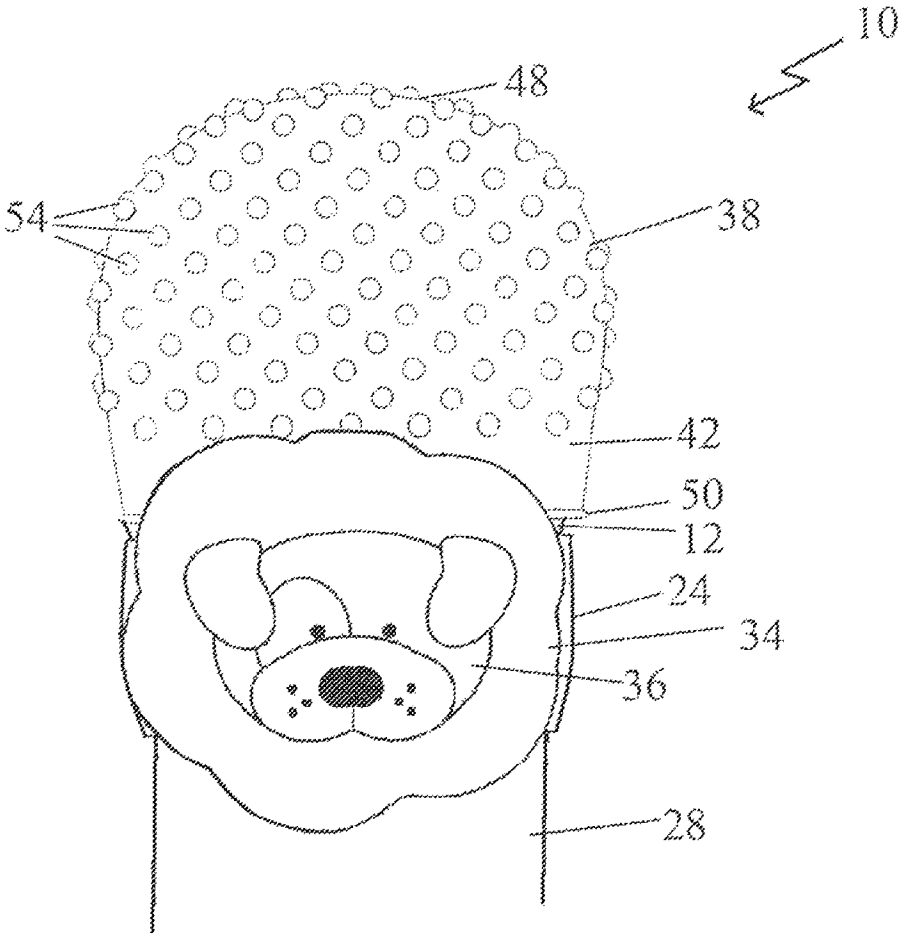
FIG. 11 is a front view of the teething mitten of FIG. 1 secured over the hand of an infant.

It is also intended that the sleeve 38 be removable so that it can be washed or sterilized as desired. Referring to FIGS. 7 and 8, apertures 56 are provided in the first side 40 and the second side 42 toward the first end 52 of the detachable sleeve 38. Closable tabs 58, best shown in FIGS. 2, 5 and 6, are provided on the first exterior side 14 and second exterior side 16 of the fabric pocket 12. Tabs 58 can be threaded through the aperture 56 and folded over to secure and maintain the sleeve 38 in position overlying the pocket 12. Tabs 58 can be disengaged and unthreaded from apertures 56 to remove the sleeve 38 from the pocket 12. While closable tabs 58 are illustrated, it will be appreciated that any suitable means can be used instead of or in addition to the tabs 58 to ensure that the sleeve 38 is maintained in position over the pocket 12. For example, snaps, Velcro®, or ties can be used to prevent sleeve 38 from accidentally becoming disengaged from the pocket 12.

The first embodiment of the teething mitten 10 is intended to be used with infants in two stages. In the first stage, the teething mitten 10 can be used without the sleeve 38, as illustrated in FIG. 3. The pocket 12 of the teething mitten 10 is fitted over an infant's hand 20 by sliding the infant's hand 20 through the opening 22 in the pocket 12 as shown in FIG. 4. The elongate strap 24 is then wrapped around the infant's wrist 28 and the mating tape 32 at the opposed ends 30 is mated to maintain the pocket 12 in place on the infant's hand 20. While wearing the teething mitten 10 on which a toy 34 is provided, the toy 34 serves as a visual stimulant to attract and engage the attention of the infant.

As the infant matures and progresses to the teething stage, the second stage of the teething mitten 10 can be utilized. In the second stage, the detachable sleeve 38 is fitted over the fabric pocket 12 and secured in position by inserting the tabs 58 through the apertures 56 in the sleeve 38. With the tabs 58 maintaining the sleeve 38 in position, the infant is able to chew on the sleeve 38 during the teething phase. As noted above, sleeve 38 is detachable, so it can be removed for washing or sterilization as necessary, while the remaining portions of the teething mitten 10 can also be washed.

Figure 12:
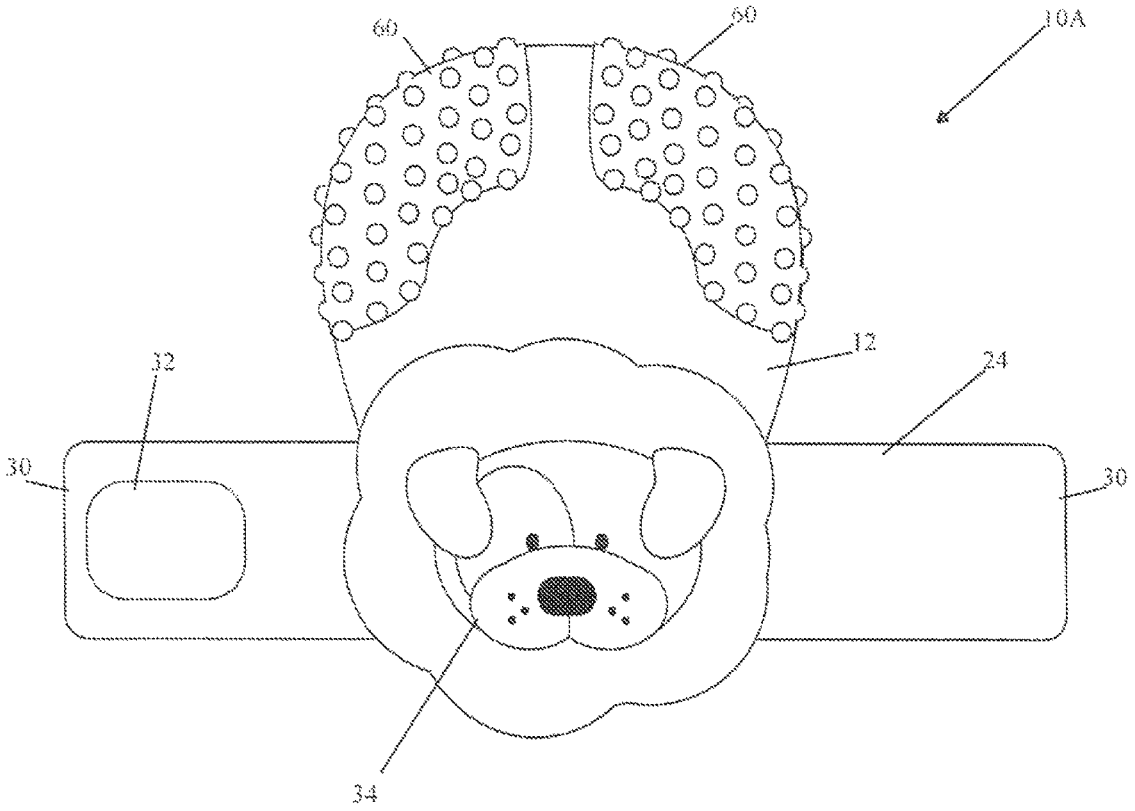
FIG. 12 is a front view of a second embodiment of the teething mitten.
Figure 13:
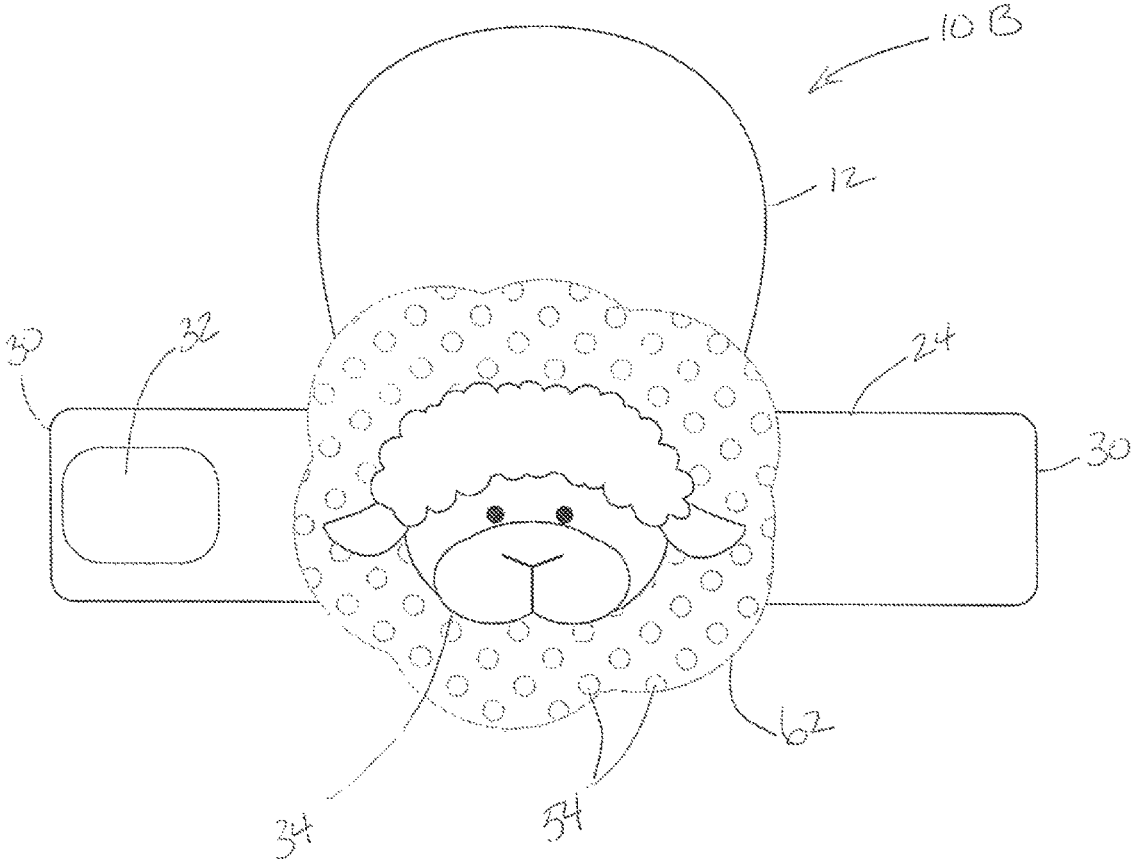
FIG. 13 is a front view of a third embodiment of the teething mitten.
Figure 15:
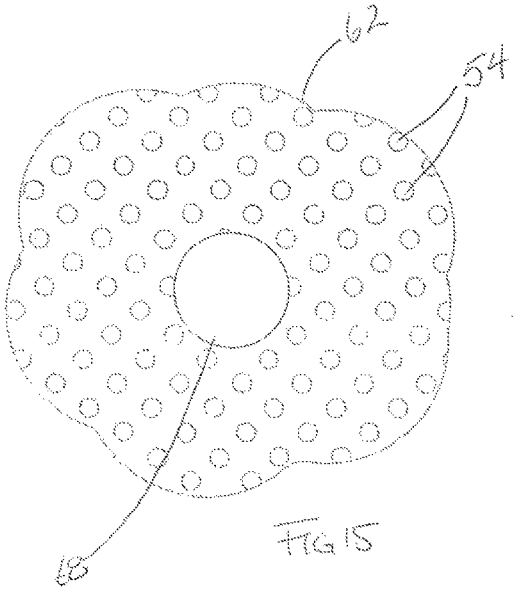
FIG. 15 is a view of a teether for the teething mitten of FIG. 13.
Figure 14:
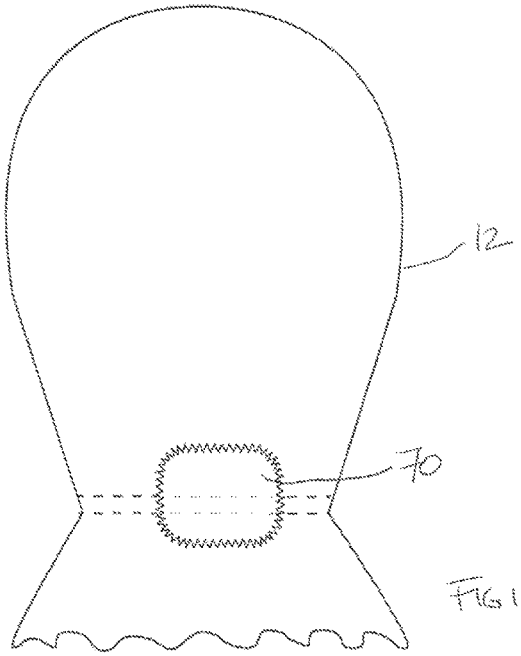
FIG. 14 is a view of a pocket for the teething mitten of FIG. 13.
Figure 16:
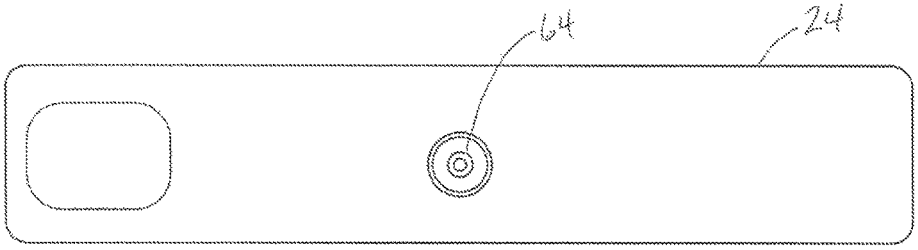
FIG. 16 is a view of the elongate strap of the teething mitten of FIG. 13.
Figure 17:
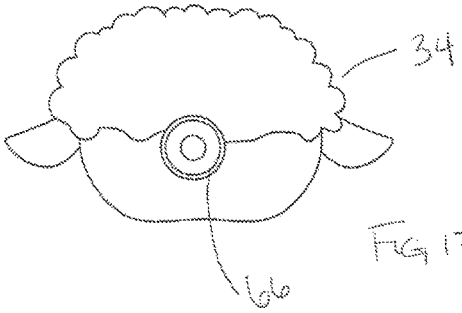
FIG. 17 is a rear view of a toy for the teething mitten of FIG. 13.

FIG. 12 shows a second embodiment of the teething mitten, designated 10A. In this embodiment, the teething member comprises one or more textured portions 60 which are permanently affixed to pocket 12A. Affixation may be through any suitable non-toxic method to provide a safe and effective teething surface, such as sewing, heat bonding, use of food safe adhesive or a combination of these methods. As with the detachable sleeve, textured portions 60 are substantially or partially covered in textures, such as teething bumps 54, or other textures and patterns of raised protrusions that may be used to facilitate teething. It will be appreciated that a combination of different textures and patterns of raised bumps could also be used for the textured portions 60, as well as different colours and opacities. Also as with the detachable sleeve 38, textured portions 60 are preferably fabricated from food or medical grade silicon or a similar material that is safe, hygienic and sufficiently flexible to be comfortable for the infant wearing the teething mitten 10A but sufficiently resilient that it will not break down under repeated chewing and teething efforts while preventing excess pressure from being applied to the infant's hand. It will be understood that the textured portions 60 are shown for illustration only, and that any or all of the shape, number and placement of the textured portions 60 on pocket 12A may be changed from that shown in FIG. 12.

The teething mitten 10A is used in two stages simply by using a plain pocket 12 as in the first embodiment illustrated in FIG. 3 during the first protective stage, then removing the pocket 12 from elongate strap 24 and replacing it with fabric pocket 12A, or providing a different elongate strap 24 attached or attachable to fabric pocket 12A for the second teething stage. A toy 34 may be provided on elongate strap 24 at either stage.

FIGS. 13-17 show a third embodiment of the teething mitten, designated 10B. In this embodiment, the teething member comprises a teether 62 which is preferably substantially or partially textured with, for example, teething bumps 54, or other textures and patterns of raised protrusions that may be used to facilitate teething. The properties and possibilities described with reference to the other teething members are also applicable to the teether 62, including being made of a material that is sale, hygienic and sufficiently resilient that it will not disintegrate under repeated chewing and teething efforts, and being provided in a variety of patterns, colours, opacities and other properties that may appeal to infants. Teether 62 is preferably separable from strap 24 and toy 34, but may be permanently attached to one or both of strap 24 and toy 34. Teether 62 may be directly attachable to strap 24 and/or toy 34, or may be held in place by a connection between the strap 24 and toy 34, such as by snaps 64, 66 on the strap 24 and toy 34, respectively, or by any other suitable attachment means, that pass through an aperture 68 in ruff 62. It will be understood that the teether may be of any shape, and is not restricted to the shape as illustrated.

The teething mitten 10B is used in two stages simply by using a plain pocket 12 as in the first embodiment illustrated in FIG. 3 during the first protective stage, then adding the teether 62 to elongate strap 24, or providing a different elongate strap 24 to which a teether 62 is attached or attachable for the second teething stage. Again, a toy 34 may be provided on elongate strap 24 at either stage.

Figure 18:
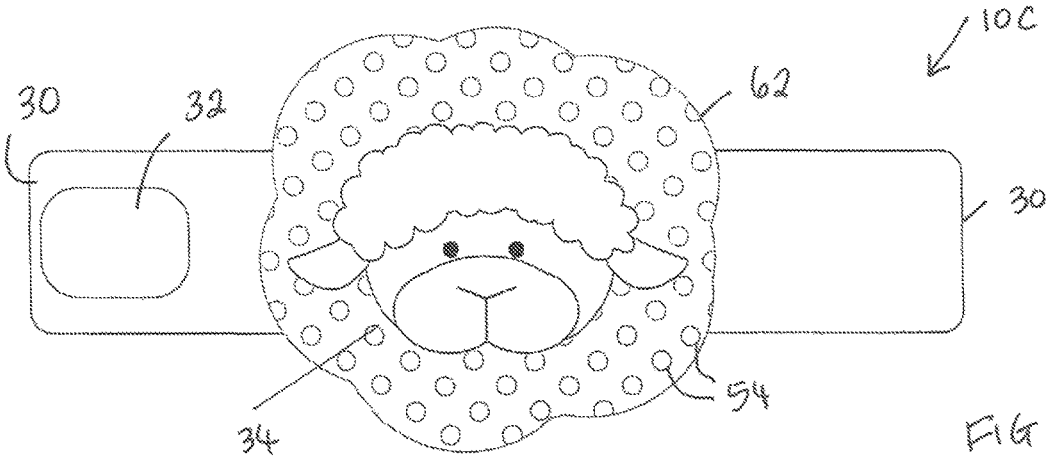
FIG. 18 is a front view of the teething mitten without a pocket.

In this embodiment, strap 24 is also preferably removably secured to pocket 12, such as by a fastener 70 or other suitable securing means. It is therefore contemplated that the teething mitten 10C, as best shown in FIG. 18, may be used without a pocket. This variation may be useful, for example, if the infant does not like having its fingers enclosed, but may still want to chew on the teether 62, or play with the toy 34.

While the illustrated embodiments show various animal characters, it will be appreciated that any number of characters, human, animals or compositions could be used that would be attractive to an infant.

The pocket 12 as illustrated does not show a thumb pocket or aperture to separately accommodate an infant's thumb, however it is conceivable that one could be provided in the pocket 12 and, if necessary, in the sleeve 38.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practised other than as specifically illustrated and described.

What is claimed is:

1. A teething mitten comprising:

a fabric enclosure having an interior cavity configured to enclose a hand of an infant, the fabric enclosure having first and second ends, the first end of the fabric enclosure having an opening configured to accommodate insertion of the hand of the infant into the interior cavity;

a detachable elongate strap having first and second ends, the first and second ends of the detachable elongate strap comprise means for detachably fastening the first and second ends together, the detachable elongate strap is removably attached to the first end of the fabric enclosure and configured to secure the opening in the fabric enclosure about a wrist of the infant when the first and second ends of the detachable elongate strap are fastened together;

a detachable teething cover defining an interior cavity, the detachable teething cover having an opening at a first end, the opening configured to receive the fabric enclosure, the detachable teething cover having a rounded lip extending about the opening in the detachable teething cover, the rounded lip extending circumferentially about the fabric enclosure when the fabric enclosure is received within the detachable teething cover, the detachable teething cover having a textured teething surface provided on at least a portion of an outer surface of the detachable teething cover, and the detachable teething cover is removably attached to the fabric enclosure;

the detachable teething cover comprises a plurality of apertures at the first end of the detachable teething cover, the fabric enclosure comprises a plurality of tabs, wherein the tabs are threadable through the apertures to secure the detachable teething cover to the fabric enclosure.

2. The teething mitten of claim 1 wherein the textured teething surface is a plurality of raised projections.

3. The teething mitten of claim 1 wherein the means for fastening the first and second ends of the detachable elongate strap comprise a connector selected from the group consisting of mating tape, hook and loop fasteners, snap closures, ties, elastic, and buttons.

4. The teething mitten of claim 1, wherein the detachable elongate strap is provided with a hook and loop fastener or a first snap that is engageable to a corresponding hook and loop fastener or a corresponding second snap provided at the first end of the fabric enclosure.

5. The teething mitten of claim 1, further comprising a toy removably attached to the detachable elongate strap.

6. A teething mitten comprising:

a fabric enclosure having an interior cavity configured to enclose a hand of an infant, the fabric enclosure having a first end, the first end of the fabric enclosure having an opening configured to accommodate insertion of the hand of the infant into the interior cavity;

a detachable elongate strap having first and second ends, the detachable elongate strap is removably attached to the first end of the fabric enclosure and configured to secure the opening in the fabric enclosure about a wrist of the infant;

a toy removably attached to the detachable elongate strap;

a fastener configured to removably attach the toy to the detachable elongate strap;

a collar-shaped teether removably attached between the detachable elongate strap and the toy, the collar-shaped teether defining an aperture therethrough, the fastener extending between the detachable elongate strap and the toy through the aperture to secure the collar-shaped teether between the detachable elongate strap and the toy, at least a portion of the collar-shaped teether having a textured teething surface.

7. A teething mitten as defined in claim 6 wherein the first and second ends of the detachable elongate strap are provided with means for fastening the first and second ends together, and wherein the detachable elongate strap secures the opening in the fabric enclosure about the wrist of the infant when the first and second ends of the detachable elongate strap are fastened together.

8. A strap as defined in claim 7, wherein the means for fastening the first and second ends of the detachable elongate strap comprise a connector selected from the group consisting of mating tape, hook and loop fasteners, snap closures, ties, elastic, and buttons.

9. A teething mitten as defined in claim 6 wherein the fastener comprises snaps.

10. A teething mitten as defined in claim 6, wherein the fastener comprises a first snap provided on the detachable elongate strap and a second snap provided on the toy.

11. A teething mitten as defined in claim 6, wherein the toy comprises a face of an animal, and wherein the collar-shaped teether forms a ruff substantially encircling the face of the animal.

* * * * *